US006989756B2

(12) United States Patent
Rhodes et al.

(10) Patent No.: US 6,989,756 B2
(45) Date of Patent: Jan. 24, 2006

(54) SMOKE DETECTOR MAINTENANCE INDICATION METHOD AND APPARATUS

(75) Inventors: Neil Rhodes, Evanston, IL (US); Tom Rule, Arlington Heights, IL (US)

(73) Assignee: Siemens Building Technologies, Inc., Buffalo Grove, IL (US)

( * ) Notice: Subject to any disclaimer, the term of this patent is extended or adjusted under 35 U.S.C. 154(b) by 75 days.

(21) Appl. No.: 10/434,388

(22) Filed: May 8, 2003

(65) Prior Publication Data

US 2003/0234732 A1 Dec. 25, 2003

Related U.S. Application Data

(60) Provisional application No. 60/390,341, filed on Jun. 20, 2002.

(51) Int. Cl.
*G08B 17/10* (2006.01)

(52) U.S. Cl. ..... 340/628; 340/630; 340/870.01

(58) Field of Classification Search ..... 340/630, 340/628, 853.2, 870.01–870.09, 506, 525; 700/277

See application file for complete search history.

(56) References Cited

U.S. PATENT DOCUMENTS

| | | | | |
|---|---|---|---|---|
| 4,688,183 | A * | 8/1987 | Carll et al. | 700/275 |
| 5,155,468 | A * | 10/1992 | Stanley et al. | 340/501 |
| 5,172,096 | A * | 12/1992 | Tice et al. | 340/501 |
| 5,552,763 | A * | 9/1996 | Kirby | 340/506 |
| 6,229,429 | B1 * | 5/2001 | Horon | 340/286.01 |
| 6,735,549 | B2 * | 5/2004 | Ridolfo | 702/181 |

* cited by examiner

*Primary Examiner*—Jeffery Hofsass
*Assistant Examiner*—Eric Blount

(57) ABSTRACT

A method of displaying status information of a plurality of smoke detectors includes obtaining first data including a first measurement value representative of a maintenance condition of a first smoke detector, the first measurement value falling within a first range. The method also includes obtaining second data including a second measurement value representative of a maintenance condition of a second smoke detector, the second measurement value falling within a second range, the second range different from the first range. The method further includes displaying first information representative of the first measurement value and second information representative of the second measurement value, the first information and the second information falling within a uniform range.

20 Claims, 6 Drawing Sheets

SMOKE DETECTOR MAINTENANCE INDICATION METHOD AND APPARATUS

This application claims the benefit of U.S. Provisional Patent Application Ser. No. 60/390,341, filed Jun. 20, 2002, which is incorporated herein by reference.

CROSS REFERENCE TO RELATED APPLICATION

Cross reference is made to U.S. patent application Ser. No. 10/434,390 entitled "Integrated Communication of Building Control System and Fire Safety System Information", filed on even date herewith, and Ser. No. 10/434,491 entitled "Alarm Graphic Editor with Automatic Update, filed on even date herewith, and which is incorporated herein by reference.

FIELD OF THE INVENTION

The present invention relates generally to data display methods and apparatus in building systems, and more particularly, to data indication methods and apparatus for smoke detectors.

BACKGROUND OF THE INVENTION

Fire safety systems in buildings typically include networks of devices that detect fire conditions, devices that provide notification of fire conditions, and devices that perform specialized control operations during the existence of fire conditions. The primary fire detection equipment in such systems includes smoke detectors and pull stations.

Smoke detectors are well known in the art. Smoke detectors used in large scale fire safety systems typically employ obscuration sensors to detect the presence of smoke. The obscuration sensors in general measure the obscuration or cloudiness of the air. Obscuration may be measured and expressed as the inverse of clarity. Clarity decreases, and hence obscuration increases, in the presence of smoke. Ideally, if no smoke is present, then the obscuration measurement is minimized. In the presence of smoke, however, the obscuration measurement dramatically increases. If the obscuration measurement increases beyond a threshold, then the smoke detector generates an alarm signal.

However, in actual implementation, the obscuration sensors may accumulate dirt and other environmental substances that gradually increase the obscuration measurement value in the absence of smoke. Left unchecked, the accumulated dirt and debris can eventually cause the obscuration measurement to reach the alarm threshold, even in the complete absence of smoke or fire. Such obscuration due to non-fire condition related reasons, such as build-up of dirt, debris, or even misalignment of sensors, is referred to herein as ambient obscuration.

False alarms caused by ambient obscuration of smoke detectors are highly undesirable, as false alarms can create significant disruption to normal activities in a building.

To avoid such false alarms, smoke detectors may be periodically replaced when they exhibit significant ambient obscuration. Alternatively, smoke detectors may undergo periodic maintenance to remove the dirt and substances that can cause increases in the ambient obscuration measurement value. Because such maintenance is labor intensive, it is desirable to strike a balance between performing frequent, unnecessary maintenance, and performing too infrequence maintenance that can result in false alarms.

To this end, sophisticated building fire safety systems often employ smoke detectors that can communicate information relating to their need for maintenance. The information may include information regarding the ambient obscuration level as measured by the sensors in non-fire conditions. The maintenance related information for a plurality of smoke detectors may be displayed to a technician on a computer display. The maintenance technician then uses the information to determine which smoke detectors are in need of maintenance, if any. Such a system can reduce the cost related to unnecessary maintenance while still providing protection against false alarms caused by ambient obscuration.

A drawback of the maintenance information display systems in current fire safety systems is that such systems can produce maintenance information that is relatively non-intuitive to the technician or user. In particular, fire safety systems do not necessarily employ all of the same types of smoke detectors. Different types of smoke detectors often provide maintenance related information in different formats. Thus, when the information is displayed, a high level of system and smoke detector knowledge may be required to discern which smoke detectors require maintenance.

Moreover, even smoke detectors of the same type may employ different settings that affect the maintenance related information, resulting in increased complexity in assessing when the smoke detectors require maintenance.

Accordingly, there exists a need for a system that allows for more convenient and intuitive display of smoke detector maintenance information in a fire safety system that employs a plurality of models of smoke detectors.

SUMMARY OF THE INVENTION

The present invention addresses the above needs, as well as others, by providing a method and apparatus that display information from different smoke detectors using a uniform scale. The uniform scale allows for easier comprehension of the data provided by various smoke detectors. In one embodiment, the maintenance information is presented uniformly as a percentage.

A first embodiment of the present invention is a method of displaying status information of a plurality of smoke detectors. The method includes obtaining first data including a first measurement value representative of a maintenance condition of a first smoke detector, the first measurement value falling within a first range. The method also includes obtaining second data including a second measurement value representative of a maintenance condition of a second smoke detector, the second measurement value falling within a second range, the second range different from the first range. The method further includes displaying first information representative of the first measurement value and second information representative of the second measurement value, the first information and the second information falling within a uniform range.

The above described features and advantages, as well as others, will become readily apparent to those of ordinary skill in the art by reference to the following detailed description and accompanying drawings.

DETAILED DESCRIPTION

Figure 1:
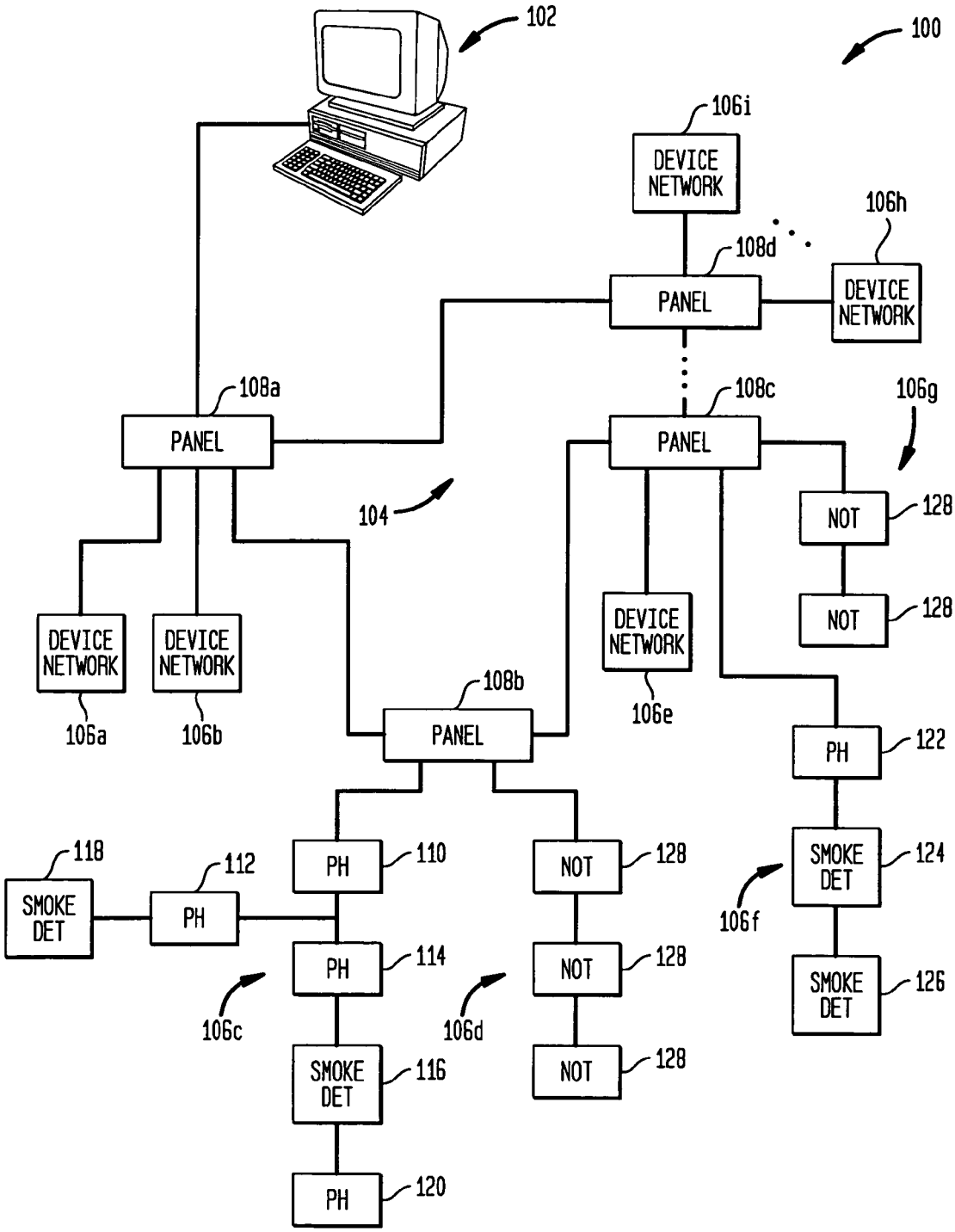
FIG. 1 shows an exemplary fire safety system that incorporates aspects of the present invention.

FIG. 1 shows a block diagram of an exemplary fire safety system 100 that incorporates an exemplary embodiment of the smoke detector maintenance information display method and apparatus of the present invention. In general, the smoke detector maintenance information display method and apparatus represents one of the many operations of the fire safety system 100. To provide proper context for the exposition of the invention, a brief discussion of some of the other operations of the fire safety system 100 is provided.

In general, the fire safety system 100 illustrates a relatively simple example of a fire safety system, but includes the salient components typical of a fire safety system. It will be appreciated that the embodiment of the invention described herein may readily be adapted to fire safety systems of different scales. More specifically, the present invention may be implemented in any system that employs multiple smoke detectors that provide maintenance related data in a variety of formats, units or scales.

Referring to FIG. 1, the fire safety system 100 includes a centralized control station 102, a building network 104, and a plurality of device networks, illustrated by exemplary device networks 106*a*, 106*b*, 106*c*, 106*d*, 106*e*, 106*f*, 106*g* and 106*h*. A series of control panels 108*a*, 108*b*, 108*c* and 108*d* logically and electrically connect the exemplary device networks 106*a* through 106*h* to the building network 104. The control panels 108*a*–108*d* are connected to each other and the control station 102 via the building network 104.

Figure 2:
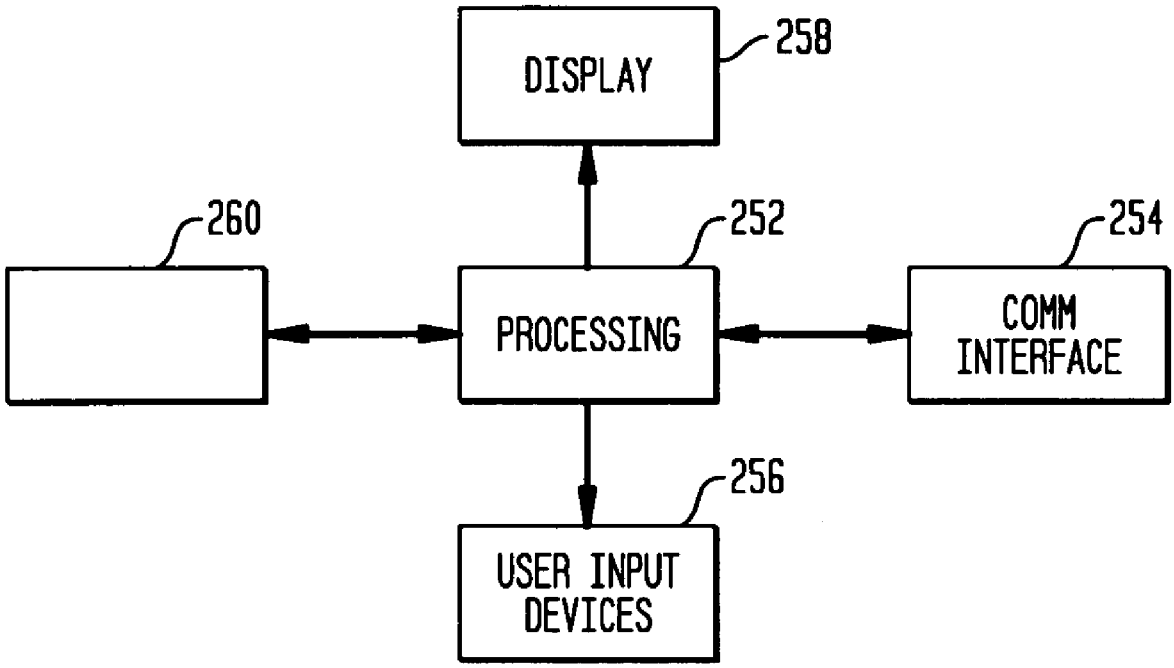
FIG. 2 shows an exemplary computing arrangement that is operable to display smoke detector maintenance related information in accordance with the present invention.

Referring now to FIG. 2, the control station 102 is implemented as a general purpose computer. To this end, the control station 102 includes a processing circuit 252, a communication interface 254, a set of user input devices 256, a display 258, and storage devices 260. The control station 102 may further include a plurality of other devices, such as modems, disk arrays, printers, scanners and other devices typically employed in connection with multipurpose computers. The processing circuit 252 may be a circuit that includes any suitable Pentium-class microprocessor available from Intel, or any comparably powered microprocessor. The display 258 may be any suitable display, including a CRT display, LCD display, or plasma screen display. The input devices 256 may suitably include pointing devices, keyboards, microphones or the like.

The storage devices 260 may include many types of memory associated with general purpose computers, including random access memory, permanent or removable disks or tapes and the like. The storage devices 260 may be distributed throughout various computers on a local area network, or even an enterprise-wide network. For the purposes of the invention described herein, the exact location and structure of the storage devices accessible to the processing circuit 252 is not of significant consequence.

The control station 102 generally provides centralized monitoring and control of various elements on the system 100. While some of the control of the devices of the fire safety system 100 is necessarily localized, the control station nevertheless 102 performs supervisory control and monitoring functions. Such functions, within the framework of the fire safety system 100, are known in the art. In addition, however, the control station 102 provides a centralized system for displaying smoke maintenance-related information for multiple types of smoke detectors in accordance with the present invention.

Figure 6:
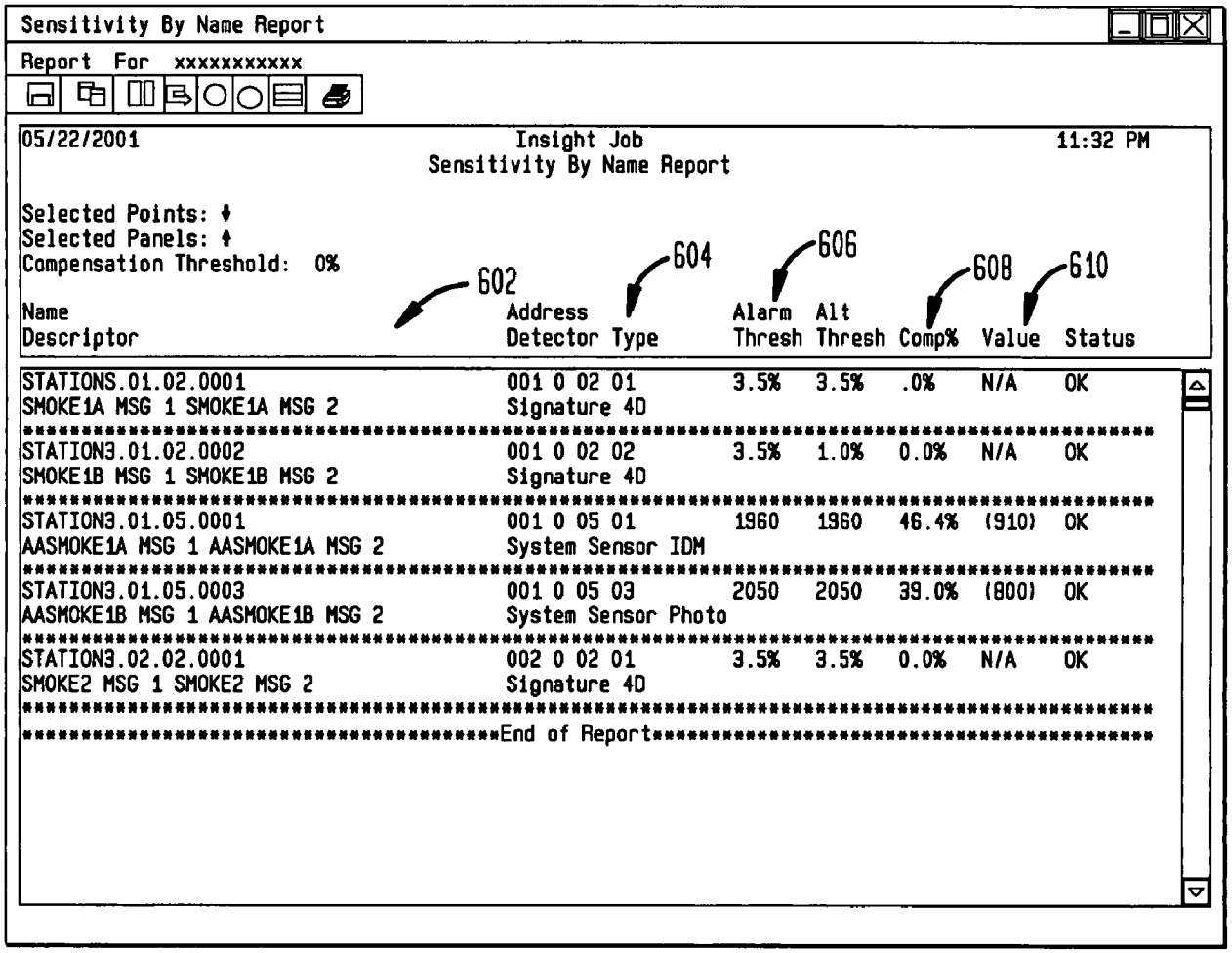
FIG. 6 shows an exemplary screen display showing smoke detector maintenance information in accordance with the present invention.

By way of example, FIG. 6 shows a sample screen display illustrating smoke detector maintenance information in an exemplary embodiment of the invention. The maintenance information in FIG. 6 is presented in tabular form, which each row representing data from an individual smoke detector in the system 100. For each smoke detector, information regarding, among other things, the smoke detector identity (column 602), an alarm threshold value (column 606), a Dirty/Comp percentage (column 608), and type identity (column 604) is presented in corresponding columns.

The smoke detector identity information allows the user to determine the source of the data. Related software and/or paper records associate the smoke detector identity with its location within the building or facility.

The alarm threshold value identifies the nominal or relative obscuration measurement that will result in an alarm. For example, the first detector on the list in FIG. 6 has a sensitivity value of 3.5%, which means that if the detector's sensors measure in excess of 3.5% obscuration, an alarm message will be generated. Other detectors in FIG. 6 employ an arbitrary integer scale for obscuration, and thus provide the alarm threshold value as an arbitrary integer value. For example, the third detector on the list in FIG. 6 has an alarm threshold value of 1960 while the fourth detector on the list has an alarm threshold value of 2050.

The Dirty/Comp percentage identifies maintenance information for the corresponding smoke detector that is obtained and/or derived from obscuration measurements. In the embodiment described herein, the Dirty/Comp percentage represents one of two different values, the value corresponding to the type of smoke detectors.

In particular, in the case of a first type of smoke detectors, "non-compensating" detectors, the Dirty/Comp percentage represents the current obscuration measurement as a percentage of the alarm threshold value. For example, the third detector of FIG. 6 has a Dirty/Comp percentage of 46.4%, which means that the current obscuration measurement is 46.4% of the alarm threshold. As shown in FIG. 6, the obscuration value itself, 910, is also displayed. Such Dirty/Comp percentage information provides the viewer with direct information as to how close the dirt and debris build-up on the smoke detector is to causing a false alarm.

In the case of other types of smoke detectors, compensating detectors, the Dirty/Comp percentage represents an amount of available ambient obscuration compensation that is used. In particular, as will be discussed below in further detail, some smoke detectors automatically compensate for dirt and/or debris or other ambient obscuration. Such compensation typically involves increasing the alarm sensitivity threshold. More specifically, the absolute alarm sensitivity threshold is increased in order to maintain the relative alarm sensitivity threshold constant relative to the ambient obfuscation.

However, there is a practical limit to how much compensation may be used. In particular, many smoke detectors cannot practically or accurately measure from 0% to 100% obscuration. As a result, a typically smoke detector may have a maximum value of measurable obscuration of roughly 15% obscuration. It is plainly apparent that the maximum compensation cannot exceed the maximum measurable value. Moreover, the maximum compensation may even be limited well below the maximum measurable obscuration value.

Accordingly, in smoke detectors that employ ambient obscuration compensation, the Dirty/Comp percentage represents the amount of available maximum compensation that has been used. Such information provides an idea of whether maintenance is necessary. For example, if only 10% of the available compensation has been used, then the smoke detector does not requiring cleaning or maintenance. However, if 95% of the compensation has been used, then maintenance of the smoke detector to clean the obscuration sensors is probably justified.

In the exemplary embodiment described herein, the Dirty/Comp percentage employs the same scale, form 0% to 100%, to display two different types of maintenance information. While the information provides different types of maintenance information in this embodiment, the use of a uniform scale allows for a quick review of the percentages and obtain a quick and intuitive feel for the numbers that require further attention. In addition, the embodiment described herein also employs the same percentage scale to display maintenance information that is originally generated using two different scales. For example, the two non-compensating detectors of FIG. 6 employ different alarm thresholds, and as a result, the ambient obscuration measurements in the two detectors would provide different indications of whether maintenance is required. By presenting the ambient obscuration measurements of both detectors on the same percentage scale, the relative needs for maintenance may be readily identified.

The concepts of the present invention may further be employed to obtain data related to either obscuration or compensation usage that is in different formats, and then render that data on a uniform scale with data from other types of smoke detectors.

Referring again generally to FIG. 2, smoke detectors of the fire safety system 100 comprise one of many categories of devices that make up the system 100. In particular, each of the device networks 106*a*–106*i* comprises a set of interconnected fire safety devices, which may include pull stations, notification devices, control devices, as well as smoke detectors. Typically, fire safety devices may be categorized as initiating devices, notification devices, and control devices. Initiating devices, such as pull stations and smoke detectors, detect conditions indicative of a possible fire emergency. Notification devices, such as strobe "fire" lights, audible alarms, and voice notification devices, provide human perceptible indications of the presence of a fire or other emergency condition. Control devices may include devices that limit elevator operation, control ventilation dampers for smoke management, or control door locks in response to a fire emergency.

By way of example, the device network 106*c* is a network that is comprised primarily of initiating devices. To this end, the device network 106*c* includes four pull stations 110, 112, 114, 120 and two smoke detectors 116, 118. The devices are connected to each other and to the control panel 108*b* via a digital communication network. By way of example, the communication network may suitably be the ALS3 network, which is known in the art. The pull stations 110, 112, 114, 120 and the smoke detectors 116, 118 are dispersed throughout a floor or zone of a building.

Each of the pull station 110, 112, 114, and 120 is a manually actuated fire alarm device, typically located in a hallway or common area. When the pull station is actuated by person, an alarm is initiated.

Figure 4:
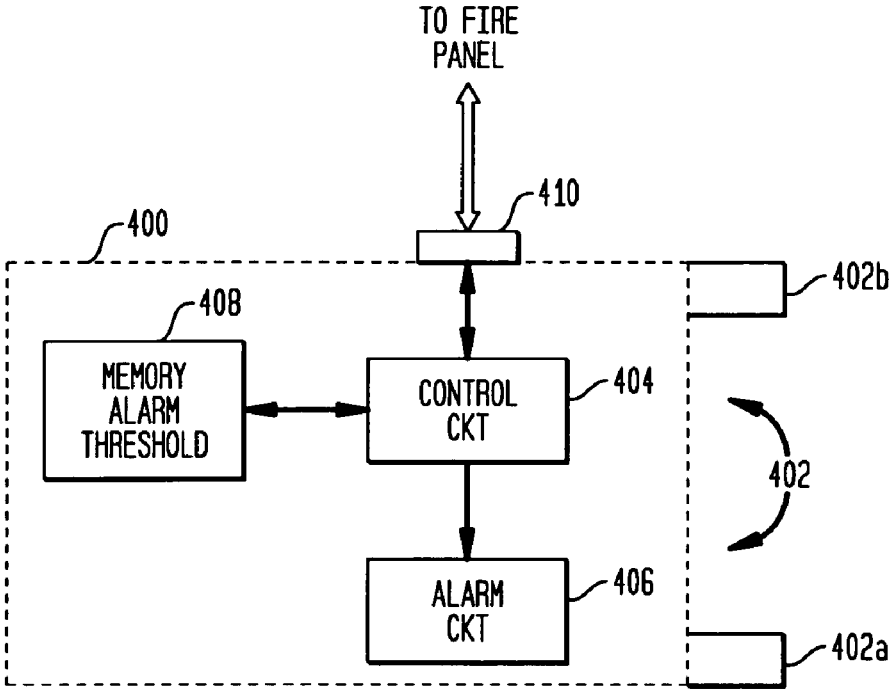
FIG. 4 shows a block diagram of a first exemplary smoke detector that may be used in the fire safety system of FIG. 1.

The smoke detectors 116 and 118 in the embodiment described herein are non-compensating smoke detectors. FIG. 4 shows a block diagram of an exemplary embodiment of a non-compensating smoke detector 400. The smoke detector 400 may suitably be a model 1251F ionization detector or 2251F photoelectric detector available from Siemens Building Technologies, Inc.

The non-compensating smoke detector 400 includes an obscuration sensor 402, a control circuit 404, a local alarm circuit 406, an alarm threshold storage device 408, and an external communication interface 410. The obscuration sensor 402 is a device or set of devices that determine the degree of obscuration in the ambient air. To this end, the obscuration sensor 402 may suitably comprise a light transmitter 402*a* and an optical receiver 402*b*. The obscuration sensor 402 is operably connected to provide obscuration sensor signals to the control circuit 404.

The external communication interface 410 is operably coupled to a device network (e.g. device network 106*c*) to provide communications between the smoke detector 400 and other elements in the system 100 (see FIG. 2).

The local alarm circuit 406 is a device that is operable to provide an audible and/or visible indication responsive to signals from the control circuit 404. The local alarm circuit 406 may further provide an audible and/or visible indication responsive to signals received from an external device through the communication interface 410.

The alarm threshold storage device 408 is a device that stores data representative of the alarm threshold for the detector 400. The threshold data may be a number on an arbitrary scale used for obscuration measurements. For example, in the model 1251F or 2251F detectors discussed above, the alarm threshold may be adjusted to values on a scale of 0 to 2550, which corresponds roughly to 0% to 15% obscuration. The storage device 408 is preferably reprogrammable so that the threshold may be adjusted as needed. To this end, the storage device 408 may suitably be a flash programmable memory, a DIP switch, or other programmable non-volatile memory.

The control circuit 404 is a circuit that is operable to convert the obscuration sensor signals to a digital value. In particular, the control circuit 404 receives the analog light measurement from the optical receiver 402*b* and generates a corresponding digital obscuration value on a scale of 0 to 2550, with zero representing no obscuration and 2550 representing the highest level of obscuration that the detector is able to report.

The control circuit 404 is further operable to determine whether the digital obscuration value exceeds the alarm value threshold. If so, then the control circuit 404 sends a control signal to the local alarm circuit 408 to generate an alarm indication, and furthermore generates an alarm message for external communication through the communication interface 410.

In addition, the control circuit 404 is operable to, from time to time, communicate data representative of the alarm threshold and a relatively current obscuration measurement to the control station 102 via the external communication interface 410. Such information is provided in the absence of an alarm condition so that the control station 102 receives periodic information indicating whether a significant amount of ambient obscuration is present. If so, then maintenance may be required. As discussed above, ambient obscuration measurements (i.e., during steady state conditions) can result from dust or debris build-up within the sensor chamber that encloses the optical transmitter 402*a* and/or the optical receiver 402*b*. Moreover, gradual misalignment or other mechanical forces or obstructions may cause changes in ambient obscuration. All of such conditions may typically be corrected with routine maintenance.

It is noted that the precise architecture of the non-compensating smoke detector 400 may vary. However, non-compensating smoke detectors include some type of obscuration sensor and some method of communicating obscuration measurements. In some embodiments, the smoke detector itself need not include an alarm threshold storage device. In such an embodiment, the comparison of measured results and the alarm threshold occurs at an external device, such as the control station 102 or the fire control panel 108*c*. In other embodiments, the smoke detector may not include its own alarm circuit.

Referring again generally to the device network 106*c* of FIG. 1, the smoke detectors 116, 118 in the embodiment described herein communicate alarm messages and maintenance information to the attached fire control panel 108*b* via the network 106*c*. The control panel 108*b* further communicates any alarm messages and maintenance information to the control station 102 using the communication network 104.

Referring briefly to the other elements of the device network 106*c*, the pull a person to indicate a fire alarm. If a pull station actuator has been manipulated, the relevant pull station provides an alarm message to the control panel 108*b*, the alarm message including the pull station's identity. The control panel 108*b* thereafter communicates the alarm message including identity information to the control station 102 using the communication network 104.

While the network 106*c* described above employs two similar non-compensating smoke detectors 116 and 118, other device networks employ another type of smoke detector, namely, a compensating type smoke detector. For example, the device network 106*f* in the embodiment described includes a pull station 122 and two compensating smoke detectors 124, 126. The network 106*f* terminates in the fire control panel 108*c*.

Figure 5:
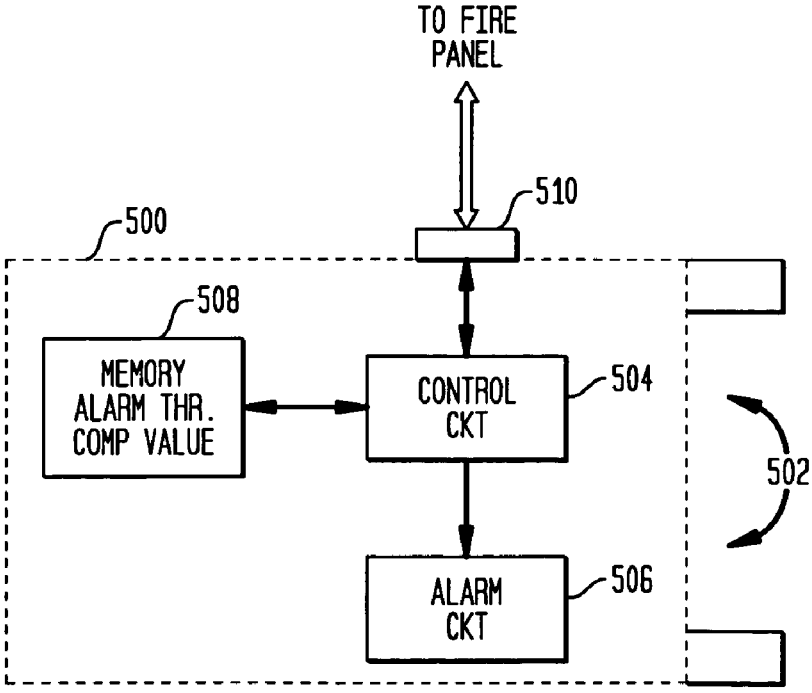
FIG. 5 shows a block diagram of a second exemplary smoke detector that may be used in the fire safety system of FIG. 1.

FIG. 5 shows a block diagram of an exemplary compensating type smoke detector which may be use as the smoke detectors 124 and 126. The compensating smoke detector 500 includes an obscuration sensor 502, a control circuit 504, a local alarm circuit 506, a storage device 508, and an external communication interface 510. The compensating smoke detector 500 may suitably be the commercially available SIGA-PS-LG model detector available from Siemens Building Technologies, Inc.

The obscuration sensor 502 may suitably have a similar overall structure as that of the obscuration sensor 402 of FIG. 4. Likewise, the external communication interface 510 and local alarm circuit 506 may suitably comprises circuits functionally similar to the interface 410 and alarm circuit 406, respectively, of FIG. 4.

The storage device 508 is a device that stores data representative of the alarm threshold for the detector 500. As with the detector 400, the threshold data may be a number on an arbitrary scale used for obscuration measurements. In general, however, this scale will not be the same as the scale used by the non-compensating detector 400. The obscuration measurement scale used by compensating and non-compensating detectors arise primarily from a lack of an industry standard for the scale. Thus, different manufacturers of smoke detectors, and even different models of smoke detectors having the same manufacture may employ different arbitrary scales.

In any event, the exemplary SIGA-PS-LG model compensating detector employs a percentage scale. Thus, the storage device 508 in such embodiment stores information which is a defined percentage of the overall scale, for example 3.5%. The storage device 508 is preferably reprogrammable so that the threshold may be adjusted as needed. To this end, the storage device 508 may suitably be a flash programmable memory, a DIP switch, or other programmable non-volatile memory.

The storage device 508 further preferably stores a compensation value, which is an internal adjustment applied to compensate for accumulated ambient obscuration. The compensation value may alternatively be stored in local RAM of the control circuit 504. Further detail regarding the compensation value is provided below in connection with the description of the control circuit 504.

The control circuit 504 is a circuit that is operable to convert the obscuration sensor signals to a digital value, similar to the control circuit 404 of FIG. 4. In addition, however, the control circuit 504 of FIG. 5 is further operable to determine whether the digital obscuration value exceeds the alarm threshold as adjusted by the compensation value. The compensation value, stored in the storage device 508, represents an increase in the alarm threshold applied to compensate for the ambient, steady state obscuration value measured in the absence of smoke. The control circuit 504 is further operable to generate the compensation value from time to time based on the ambient obscuration value.

For example, if the ambient obscuration value as measured over the course of several days is the equivalent of 2%, then the control circuit 504 determines the compensation value to be 2% and stores the compensation value (or some scalar equivalent) in the storage device 508.

As discussed further above, there is a limit to the compensation value that may be applied. This limit, referred to as the compensation limit, represents the maximum available compensation value. Once the compensation value reaches the limit, the control circuit 504 cannot define a higher compensation value. The compensation limit is necessary to avoid raising the compensating alarm threshold beyond the range of the sensor within the detector.

In operation, the control circuit 504 only signals an alarm condition if the current obscuration measurement exceeds the nominal sensitivity threshold plus the compensation value.

Figure 7:
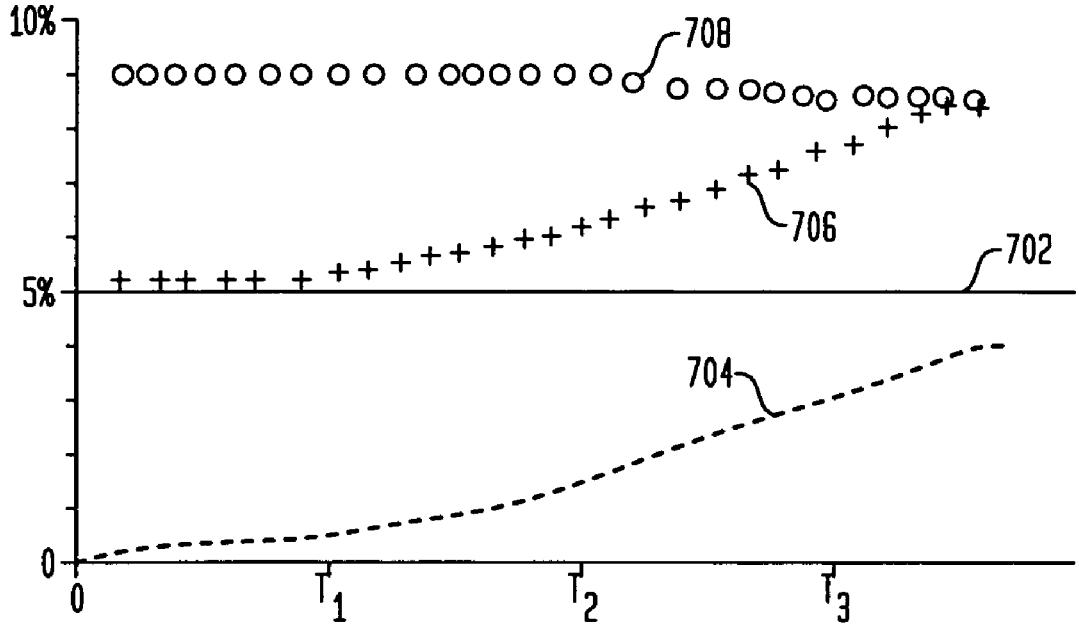
FIG. 7 shows a timing diagram of various smoke detector values of the smoke detector of FIG. 5.

FIG. 7 illustrates the relationship between the obscuration measurement value, sensitivity threshold, and compensation value in the detector 500. In particular FIG. 7 shows an exemplary timing diagram of various values of the smoke detector 500 over a long duration of time, for example, several months. The line 702 represents the nominal alarm threshold value of 5%, which remains constant. The line 704 shows the obscuration measurement value (in percentage units), which gradually increases over time as dust and other debris accumulates within the sensor 502. The line 706 represents the compensated alarm threshold value, which increases generally as a function of the average obscuration measurement value. The compensated alarm threshold value is the sum of the nominal threshold value (line 702) and the compensation value.

Line 708 illustrates the sum of the compensation limit and the nominal alarm threshold value. In this example, the compensation limit is 4%, and therefore the sum of the nominal alarm threshold value and the compensation limit is 9%.

Referring again to the normal obscuration measurement operation of the control circuit 504, if the obscuration measurement exceeds the nominal threshold value plus the compensation value (i.e. the compensated threshold value), then the control circuit 504 sends a control signal to the local alarm circuit 508 to generate an alarm indication, and furthermore generates an alarm message for external communication through the communication interface 510.

In addition, the control circuit 504 is operable to, from time to time, communicate data representative of the sensitivity threshold and information representative of compensation value to the control station 102 via the external communication interface 510.

The compensation value information is provided to the control station 102 so that a system operator may determine whether a significant amount of ambient obscuration is present. As discussed above, if a significant amount of ambient obscuration is present, then the compensation value will be relatively high. Accordingly, the compensation value provides the data necessary to determine whether maintenance of the smoke detector 500 is required.

In the embodiment described herein, the compensation value information provided by the control circuit 504 is the current compensation value expressed as a percentage of the maximum compensation value. Other values may be used, however.

It is noted that the precise architecture of the compensating smoke detector 500 may vary. However, compensating smoke detectors include some type of obscuration sensor and some method of communicating current compensation value information.

Referring again to FIG. 2 and the discussion of the network 106*f* in general, the fire control panel 108*c* is operable to obtain alarm messages from the devices 122, 124 and 126 and provide alarm messages to the control station 102. The control panel 108*c* also receives the maintenance-related information (alarm threshold and/or compensation value information) from the smoke detectors 124 and 126. The control panel 108*c* further communicates such maintenance-related information to the control station 102 via the building network 104.

Referring briefly to other types of devices in the fires safety system 100 for purposes of context, the device network 106*d* represents an example of a notification device network. The notification device network is comprised of three notification devices 128. These devices 128 are also dispersed throughout a floor or zone of a building. The devices 128 are configured to receive alarm notification signals from the control panel 108*b* and generate a visual or audible signal responsive thereto. The notification devices 128, may for example, be flashing strobes, or combined strobe and audible horns. It is noted that the notification devices 128 need not be individually addressable, but instead may simply be interconnected by an analog signal network. For example, the notification devices 128 may generate audible or visual alarms responsive to the presence of a 24 volt analog signal, or to certain signals modulated on an analog carrier signal.

It is noted that the device network 106*c* and the device network 106*d* are preferably dispersed throughout the same general area, for example, on the same floor or zone of the same building. To this end, it is noted that each of the control panels 108*a*–108*d* is a building level, floor level or zone level controller to which individual device networks 106*x* located in that building, floor or zone may be connected.

As discussed above, the control station 102 is operable to display, upon request by the user via the user input devices 256, maintenance status information received form the various smoke detectors, including the smoke detectors 116, 118, 124 and 126. In particular, the control station 102 receives the maintenance information from both compensating and non-compensating smoke detectors and displays the information using a uniform scale. It will readily be appreciated that maintenance information provided in various forms using various scales may all be converted to be displayed using a single uniform scale as taught herein.

Referring specifically to the embodiment described herein, the non-compensating detectors such as the detectors 116 and 118 provide information in the form of raw numbers for both the alarm threshold and obscuration measurements. For example, the alarm threshold data may be 1960 and the obscuration measurement value may be 910, both on a scale of roughly 2550.

It will be appreciated that the processing circuit 254 of the control station 102 receives data messages that includes data protocol and/or header information, and may include data in encoded format. The maintenance-related information is provided as raw numbers on the arbitrary numerical scale after the message is parsed and decoded.

In contrast to the non-compensating detectors, the compensating detectors such as the detectors 124 and 126 provide information in the form of percentages for both the alarm threshold and available compensation usage (available compensation usage is the amount of the compensation value as a function of the compensation limit). For example, the alarm threshold data may be 3.5% and the available compensation usage data may indicate that the current compensation value is 25% of the maximum compensation value. See, e.g. first detector on list of FIG. 6.

In the exemplary embodiment described herein, the processing circuit 254 of the control station 102 converts the maintenance-related information from the non-compensating detectors into a value on a percentage scale, such that maintenance-related information from both types of detectors (and even non-compensating detectors having different alarm thresholds) are in terms of percentages. Thus, in the example described above the obscuration measurement 910 is expressed as a percentage of the alarm threshold 1960, yielding a percentage dirty of 46.4%. As a consequence, all maintenance related data is expressed as a percentage, regardless of the type of smoke detector or the format of the maintenance-related data provided by the smoke detector.

Figure 3:
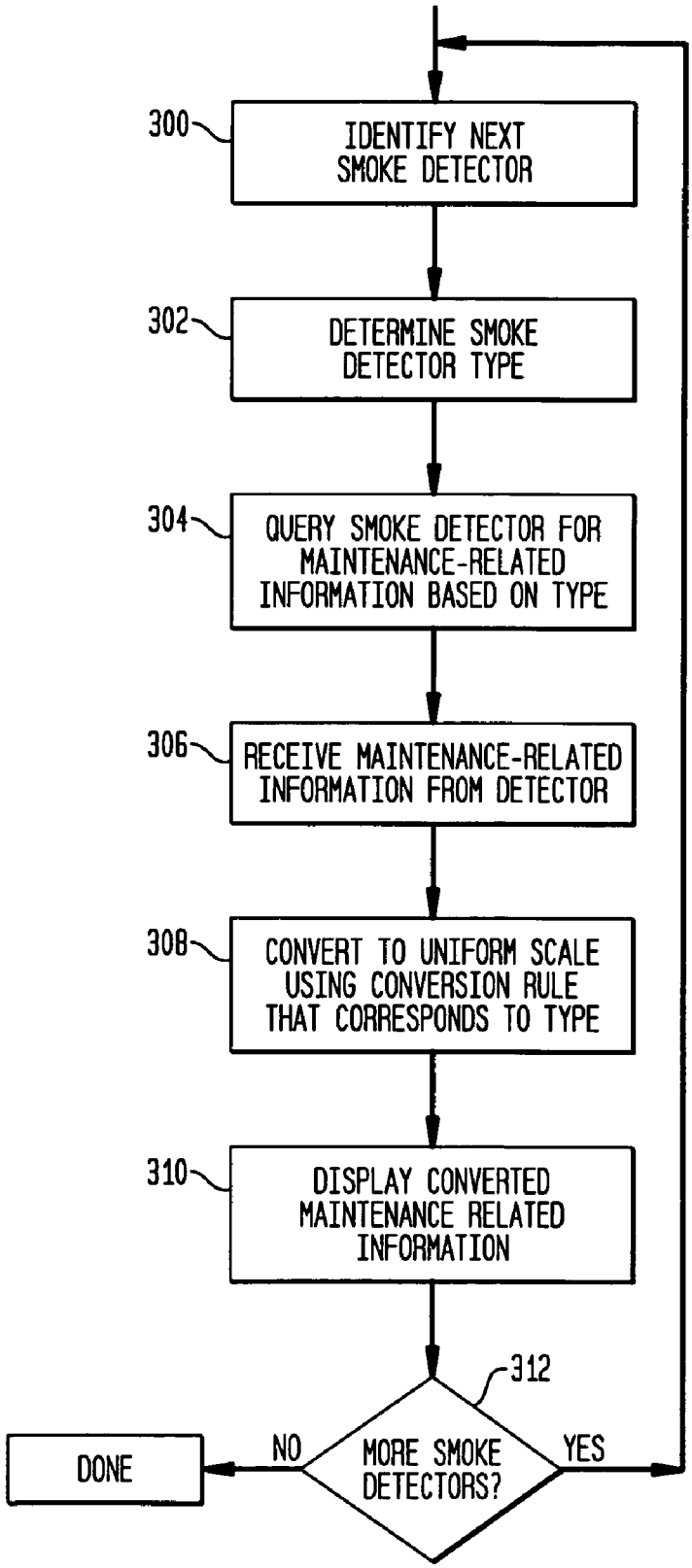
FIG. 3 shows a flow diagram of an exemplary set of operations executed by the computing arrangement of FIG. 2.

FIG. 3 shows an exemplary flow diagram of the operations of the processor 252 of the control station 102 in generating a tabular list of smoke detector maintenance information such as that shown in FIG. 6. In general, an operator at the control station 102 may use the input devices 256 to select view the maintenance-related information (also called a sensitivity report) for a set of smoke detectors. Preferably, the operator may select the set of smoke detectors by physical location, by identification name or numbers, or any other suitable means. For example, the operator may elect to obtain a list of maintenance data for the set of all smoke detectors attached to a particular fire control station 108*x*, or all smoke detectors on a particular device network 106*x*, or some other defined set.

The steps 300 through 312 then obtain the maintenance data from each smoke detector in the selected set and displays the maintenance data in a list such as that shown in FIG. 6.

In step 300, the processing circuit 252 identifies the next smoke detector for which maintenance-related information should be displayed. The next smoke detector is the next of a set of selected smoke detectors for which the list of maintenance data is being generated.

Next, in step 302, the processing circuit 252 determines the type of the selected smoke detector. In the embodiment described above, the type may be a compensating or non-compensating. The type information may be generic, such as "compensating" or "non-compensating", or may simply refer to the commercial model of the smoke detector, from which the generic type may be inferred and is readily known. Moreover, it will be appreciated that other generic types may be defined. To this end, there may be several types of compensating smoke detectors and several types of non-compensating smoke detectors if such detectors are manufactured by multiple sources that use different maintenance data scales or formats.

The processing circuit 252 may suitably determine the type of the selected smoke detector by retrieving type information for the selected smoke detector from the storage devices 260. To this end, basic information on each smoke detector in the system 100, including type information, may be stored in the stored devices 260.

Thereafter, in step 304, the processing circuit 252 provides a query to the select smoke detector requesting maintenance related information. The query is provided to the device network 106*x* that includes the select detector, via the communication interface 254, the network 104, and the corresponding fire control panel 108*y*.

The type of information requested may depend on the determined smoke detector type. For example, if the smoke detector is a non-compensating type detector such as the detectors 116 or 118, the information requested includes the alarm threshold value and the current obscuration measurement value. If instead the smoke detector is a compensating type such as the detectors 124 or 126, then the requested information includes the alarm threshold value and the available compensation usage value.

In step 306, the processing circuit 252 receives the requested maintenance related information from the smoke detector.

Thereafter, in step 308, the processing circuit 252 converts the maintenance-related information to a uniform scale using a conversion step or algorithm that corresponds to the type. In the exemplary embodiment described herein, the conversion applied to non-compensating detector maintenance-related data comprises dividing the obscuration measurement value by the alarm threshold value and expressing the result as a percentage. The conversion applied to compensating detector, comprise providing the available compensation usage value, or in other words, the current compensation value expressed as a percentage of the compensation limit. Other conversion algorithms to generate percentages from maintenance related information for other types of detectors may readily be determined by those of ordinary skill in the art based on the teachings herein.

It is noted that in the exemplary embodiment described above, the values from the compensating detectors such as detectors 124 and 126 are already expressed as percentages, and do not particularly require conversion. However, other types of compensating detectors could require conversion to obtain the compensation value as a percentage of maximum compensation value.

It will be appreciated that a uniform scale other than percentage may be used, so long as the same scale is used for the maintenance-related information from all types of detectors.

In any event, once the maintenance-related values have been converted in step 308, the processing circuit 252 displays the information in step 310. Preferably, the processing circuit 252 utilizes the display format shown in FIG. 6. In particular, each row of the display represents one smoke detector. In the first column 602 of each row, the identification of the smoke detector is provided. In the second column 604 of each row, the detector type is provided. In the embodiment shown in FIG. 6, the second column also includes the logical network address the detector.

In the third column 606, the alarm threshold value for the detector is provided. In the embodiment described herein, the alarm threshold values are displayed in the format use by the detector type. For example, the third column 606 shows alarm threshold values as percentages for the compensating detectors and shows alarm threshold values as arbitrary scale numbers for the non-compensating values. In the case of a compensating smoke detector, the sensitivity setting is the nominal sensitivity percentage, before compensation, such as line 702 of FIG. 7.

In other embodiments, all of the alarm threshold values may be converted and displayed using a uniform scale such as a percentage.

In the Dirty/Comp% column 608, the maintenance-related information is displayed using the converted uniform scale. Thus, for a row containing a compensating smoke detector, the third column will contain its available compensation usage value expressed as a percentage. As discussed above the available compensation usage value is the compensation value expressed as a percentage of the compensation limit.

In the value column 610, the obscuration measurement value for the detector is provided. In the embodiment described herein, the obscuration measurement value is displayed only for non-compensating smoke detectors. In particular, because compensating smoke detectors use the compensation value to negate any ambient obscuration measurements, the net ambient obscuration measurement (obscuration measurement minus the compensation value) will always be zero until the compensation limit is reached. Because it is presumed that a smoke detector will undergo maintenance when the compensation value nears 100%, there typically will never be any obscuration measurement to report. Thus, in the example described herein, the obscuration measurement value is only provided for non-compensating smoke detectors in the Value column 610.

It is noted that the two maintenance-related values (column 608) for compensating and non-compensating detectors in the above described embodiment do not necessarily use equivalent units, but rather only the same uniform scale. As a consequence, the maintenance-related percentage value in column 608 that indicates the need for maintenance may be different for compensating and non-compensating detectors. For example, a non-compensating detector may require maintenance when its third column value exceeds 50%, while a compensating detector may not require maintenance until its third column value exceeds 90%.

Nevertheless, the embodiment described above vastly improves the intuitiveness of maintenance related smoke detector reports by placing similar information, namely variable information related to degradation of the obscuration sensor, in a uniform scale. Moreover, the two maintenance-related values for compensating and non-compensating detectors in the above described embodiment both indicate the need for maintenance as they generally increase towards unity or 100%.

Referring again to FIG. 3, after displaying the row of information for the select smoke detector in step 310, the processing circuit proceeds to step 312. In step 312, the processing circuit 252 determines whether there are more smoke detectors in the set to be displayed. If so, then the processing circuit 252 returns to step 300 to identify the next smoke detector in the set. If not, however, then the display operation is completed.

It is noted that if the list is too long to fit on the display 258 of the control station 102, the list may be scrolled as is known in the art. Alternatively, the list of FIG. 6 may be provided to a printer in order to provide a hard copy. Indeed, it will be noted in general that the smoke detector maintenance information discussed herein may be provided in any human-perceptible form, such as in a printed document generated by a printing device, or as audible information from a speech synthesis device. The output may also be initially provided to a data file, which may later be displayed or printed.

It will be appreciated that the above described embodiments are merely exemplary, and that those of ordinary skill in the art may readily devise their own implementations and adaptations that incorporate the principles of the present invention and fall within the spirit and scope thereof.

We claim:

1. A method of displaying status information of a plurality of smoke detectors, comprising:

obtaining first data including a first measurement value representative of a maintenance condition of a first smoke detector, the first measurement value falling within a first range, the first measurement value including data representative of an obscuration value of the first smoke detector;

obtaining second data including a second measurement value representative of a maintenance condition of a second smoke detector, the second measurement value falling within a second range, the second range different from the first range, the second measurement value including a value representative of a fraction of remaining available compensation for ambient obscuration; and providing as human-perceptible output first information representative of the first measurement value and second information representative of the second measurement value, the first information and the second information falling within a uniform range.

2. The method of claim 1 further comprising:

converting the first measurement value to the first information such that the first information falls within the second range, such that the second range is the uniform range.

3. The method of claim 1, wherein the value representative of a fraction of remaining available compensation for ambient obscuration is a percentage of remaining available compensation; and further comprising converting the data representative of the obscuration value to a percentage of an alarm threshold value of the first smoke detector of the obscuration value.

4. The method of claim 1, further comprising: displaying smoke detector type information corresponding to the first smoke detector adjacent the first information and displaying smoke detector type information corresponding to the second smoke detector adjacent the second information, wherein the smoke detector type information corresponding to the first smoke detector is representative of a compensating smoke detector type and the smoke detector type information corresponding to the second smoke detector is representative of a non-compensating smoke detector.

5. The method of claim 1 wherein providing as human-perceptible output further comprises displaying on a display device.

6. The method of claim 1 wherein providing as human-perceptible output further comprises storing the first information and second information as a data file and subsequently providing the data file to a human-perceptible output.

7. The method of claim 1 wherein providing as human-perceptible output further comprises printing onto print media.

8. An apparatus for providing status information of a plurality of smoke detectors, comprising:

an output device operable to provide a human-perceptible output;

a processing circuit operably coupled to the display device, the processing circuit operable to obtain first data including a first measurement value representative of a maintenance condition of a first smoke detector, the first measurement value falling within a first range, the first measurement value including data representative of an obscuration value of the first smoke detector;

obtain second data including a second measurement value representative of a maintenance condition of a second smoke detector, the second measurement value falling within a second range, the second range different from the first range, the second measurement value including a value representative of a fraction of remaining available compensation for ambient obscuration; and cause the output device to provide as human perceptible output first information representative of the first measurement value and second information representative of the second measurement value, the first information and the second information falling within a uniform range.

9. The apparatus of claim 8, wherein the processing circuit is further operable to convert the first measurement value to the first information such that the first information falls within the second range, such that the second range is the uniform range.

10. The apparatus of claim 8, wherein the processing circuit is further coupled to a communication interface, the communication interface operably coupled to a fire safety system, and wherein the first smoke detector and the second smoke detector are operably coupled to the fire safety system.

11. The apparatus of claim 8, wherein the value representative of a fraction of remaining available compensation for obscuration is a percentage of remaining available compensation; and the processing circuit is further operable to convert the data representative of the obscuration value to a percentage of a sensitivity value of the first smoke detector of the obscuration value.

12. The apparatus of claim 8, wherein the processing circuit is further operable to cause the output device to provide as human-perceptible output smoke detector type information corresponding to the first smoke detector adjacent the first information and provide as human-perceptible output smoke detector type information corresponding to the second smoke detector adjacent the second information.

13. The apparatus of claim 12, wherein the smoke detector type information corresponding to the first smoke detector is representative of a compensating smoke detector type and the smoke detector type information corresponding to the second smoke detector is representative of a non-compensating smoke detector.

14. A smoke detector arrangement, comprising a first smoke detector operable to generate a first measurement value representative of a maintenance condition of the first smoke detector, the first measurement value having a first range, the first measurement value including data representative of an obscuration value of the first smoke detector;

a second smoke detector operable to generate a second measurement value representative of a maintenance condition of the second smoke detector, the second measurement value having a second range, the second measurement value including a value representative of a fraction of remaining available compensation for ambient obscuration;

a display device;

a processing circuit operably coupled to the display device, the first smoke detector and the second smoke detector, the processing circuit operable to obtain first data including the first measurement value, obtain second data including the second measurement value, and cause the display device to display first information representative of the first measurement value and second information representative of the second measurement value, the first information and the second information falling within a uniform range.

15. The smoke detector arrangement of claim 14, wherein the processing circuit is further operable to convert the first measurement value to the first information such that the first information falls within the second range, such that the second range is the uniform range.

16. The smoke detector arrangement of claim 14, further comprising a data network that operably connects the processing circuit to the first smoke detector and the second smoke detector.

17. The smoke detector arrangement of claim 14, wherein the value representative of a fraction remaining available compensation for obscuration is a percentage of remaining available compensation, and the processing circuit is further operable to convert the data representative of the obscuration value to a percentage of a sensitivity value of the first smoke detector of the obscuration value.

18. The smoke detector arrangement of claim 14, wherein the processing circuit is further operable to cause the display device to display smoke detector type information corresponding to the first smoke detector adjacent the first information and displaying smoke detector type information corresponding to the second smoke detector adjacent the second information.

19. The smoke detector arrangement of claim 18, wherein the smoke detector type information corresponding to the first smoke detector is representative of a compensating smoke detector type and the smoke detector type information corresponding to the second smoke detector is representative of a non-compensating smoke detector.

20. The method of claim 1 wherein the uniform range comprises a numerical range.

* * * * *